US007857313B2

(12) United States Patent
Downs et al.

(10) Patent No.: US 7,857,313 B2
(45) Date of Patent: Dec. 28, 2010

(54) POLYGON IDENTIFICATION BOARD GAME

(76) Inventors: Nelson Patrick Downs, 3903 Fairfax Pkwy., Alexandria, VA (US) 22312; Gregory Scott Downs, 3903 Fairfax Pkwy., Alexandria, VA (US) 22312

( * ) Notice: Subject to any disclaimer, the term of this patent is extended or adjusted under 35 U.S.C. 154(b) by 13 days.

(21) Appl. No.: 12/354,985

(22) Filed: Jan. 16, 2009

(65) Prior Publication Data

US 2009/0184469 A1 Jul. 23, 2009

Related U.S. Application Data

(60) Provisional application No. 61/022,693, filed on Jan. 22, 2008.

(51) Int. Cl.
*A63F 3/00* (2006.01)

(52) U.S. Cl. ..... 273/243; 273/287; 434/128

(58) Field of Classification Search ..... 273/243, 273/287; 434/211, 128; D21/334
See application file for complete search history.

(56) References Cited

U.S. PATENT DOCUMENTS 3,104,106 A * 9/1963 Kenney et al. ..... 273/249
3,115,345 A * 12/1963 De Temple et al. ..... 273/249
3,677,548 A * 7/1972 Hincz ..... 273/273
3,997,165 A * 12/1976 Barsky ..... 273/260
4,674,752 A * 6/1987 Brothers ..... 273/254
4,988,108 A * 1/1991 Shepard ..... 273/254
5,009,430 A * 4/1991 Yuhasz ..... 273/255

* cited by examiner

*Primary Examiner*—Vishu K. Mendiratta
(74) *Attorney, Agent, or Firm*—Foley & Lardner LLP

(57) ABSTRACT

A board game includes a board having an upper surface with a peripheral region and a central region. The peripheral region has positions for placement of player pieces thereupon, each peripheral region having located thereon an image of one of a plurality of polygonal shapes. The central region has central sub-regions, each of which has a plurality of polygonal cut-outs for receiving a corresponding one of a plurality of polygonal objects of a particular color that are shaped in a same manner as the polygonal cut-out. When a player answers a question related to polygon shapes correctly, that player places a respective polygon-shaped piece into a corresponding polygon-shaped cut-out region in his/her assigned central region. Players move player pieces a number of positions on the peripheral region of the board corresponding to dice roll numbers. When a player answers a question incorrectly, for the player's next turn, the player piece is moved in the opposite direction on the peripheral region of the board.

14 Claims, 4 Drawing Sheets

POLYGON IDENTIFICATION BOARD GAME

CROSS REFERENCE TO RELATED APPLICATIONS

This application is based upon and claims the benefit of priority from prior U.S. Provisional Patent Application 61/022,693, filed Jan. 22, 2008, the entire contents of which are incorporated herein by reference.

FIELD OF THE INVENTION

This invention is related in general to board games. This invention relates more particularly to a board game that involves learning various types of polygonal shapes in a fun and entertaining manner.

BACKGROUND OF THE INVENTION

It is well known that children in the U.S. trail other countries when it comes to learning various topics, especially in the field of mathematics, geometry in particular. For example, many children cannot correctly describe different types of polygons, such as triangles, octagons, or rhombuses.

There is a desire, as determined by the inventors of this application, to come up with a fun and entertaining way for children to learn about geometry, by creating a board game that utilizes various aspects of geometry in playing of the game. This board game can be used by math teachers as a teaching aid to provide a fun way to reaffirm the children's knowledge of polygons.

SUMMARY OF THE INVENTION

The present invention relates to a method and apparatus for a board game.

In accordance with one aspect of the invention, there is provided a method of playing a board game by a plurality of players, comprising:

a) rolling, by each of the plurality of players, a first dice having a first predetermined number of faces to determine an order in which participants will play the board game;

b) rolling, by a first player who has been determined to roll first, the first dice to determine a number of positions to move in a first direction to a new position from an initial position on a board face having a plurality of different positions;

c) answering, by the first player, a question provided on one of a plurality of question cards, the question related to polygons;

d) if the answer to the question is correct, placing, by the first player, an object having a same polygonal shape as the correct answer of the question card, into an opening provided on the board game that is shaped to receive the same polygonal shape;

e) repeating steps b) through d) for each of the other players;

f) at the next turn for the first player, based on a polygonal shape provided on the new position, rolling a particular one of a plurality of dice having different polygonal shapes for their respective faces, the particular one of the plurality of dice having a polygonal shape for its respective faces that matches the polygonal shape provided on the new position;

g) based on a number provided on a respective face of the one of the plurality of dice that is facing upwards, moving (either forward or in the reverse direction, depending on whether the answer to the last question was correct or not) to another new position from the new position on the board face;

h) repeating steps c) through g), wherein the board game is over when all of a plurality of different polygonal shapes have been placed into their respective openings provided on the game board for one of the players, or when the one of the players has completed N circuits around the game board.

In accordance with another aspect of the invention, there is provided a board game. The board game includes a board having a square-shaped upper surface with a peripheral region and a central region. The peripheral region has a plurality of positions for placement of a player pieces thereupon, each peripheral position having located thereon an image of one of a plurality of polygonal shapes. The central region of the board game has a plurality of central sub-regions, each of which has a plurality of polygonal cut-outs for receiving a corresponding one of a plurality of polygonal objects of a particular color that are shaped in a same manner as the polygonal cut-out.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION

Reference will now be made in detail to embodiments of the invention, examples of which are illustrated in the accompanying drawings. An effort has been made to use the same reference numbers throughout the drawings to refer to the same or like parts.

Unless explicitly stated otherwise, "and" can mean "or," and "or" can mean "and." For example, if a feature is described as having A, B, or C, the feature can have A, B, and C, or any combination of A, B, and C. Similarly, if a feature is described as having A, B, and C, the feature can have only one or two of A, B, or C.

Unless explicitly stated otherwise, "a" and "an" can mean "one or more than one." For example, if a device is described as having a feature X, the device may have one or more of feature X.

Figure 1:
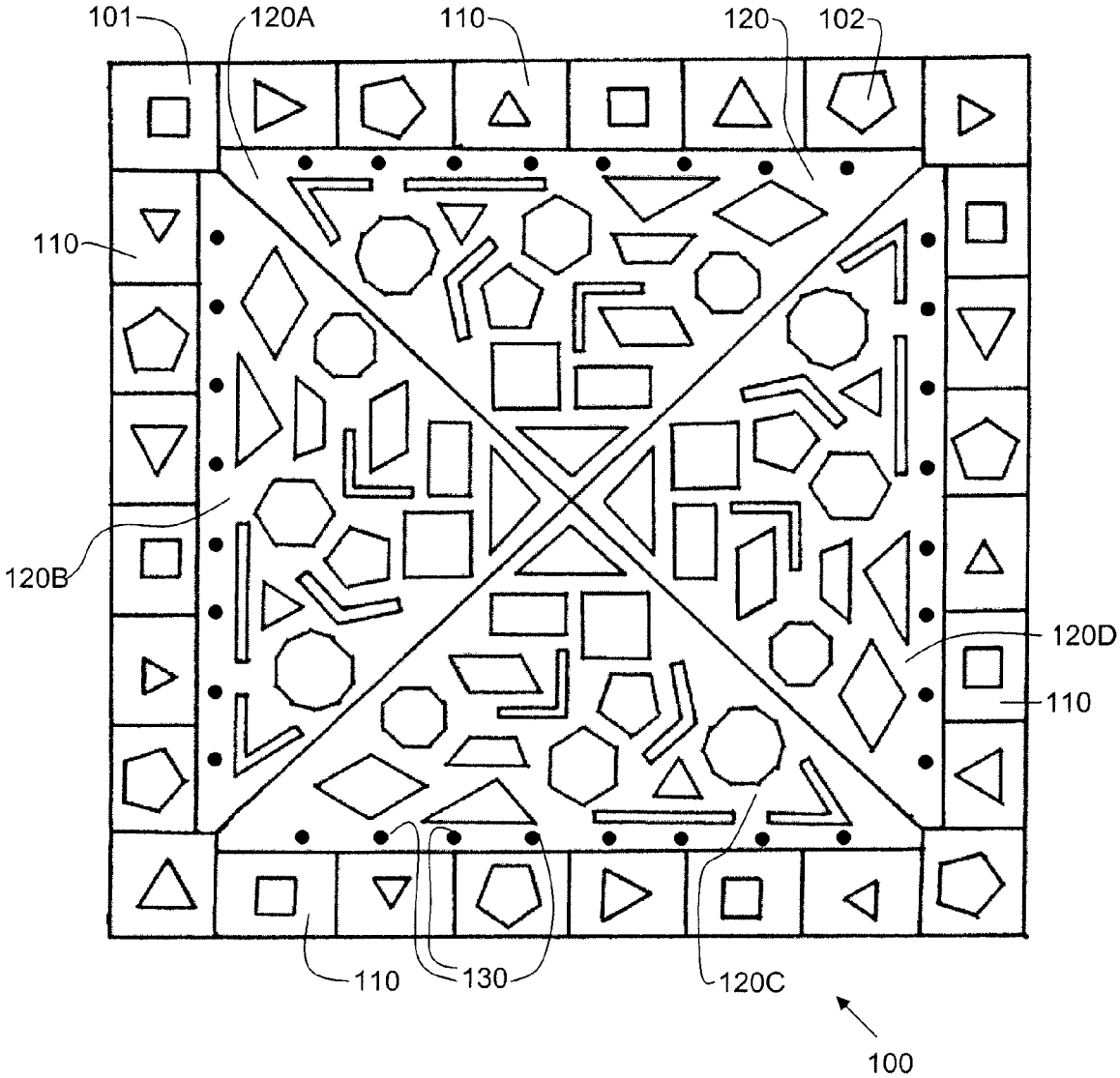
FIG. 1 is a top down view of a board game surface according to a first embodiment of the invention.

FIG. 1 is a top down view of a board game surface according to a first embodiment of the invention. As shown in that figure, a board 100 includes a top surface with a peripheral region 110 and a central region 120. The peripheral region 110 includes a plurality of positions for placement of player pieces, whereby each position includes a visual image of a particular polygonal shape. For example, certain positions have a square image provided thereon, other positions have a triangle image of a first size and disposition provided thereon, other positions have a pentagon image provided thereon, and yet other positions have a triangle image of a second size and disposition provided thereon.

The central region 120 includes four sub-regions. A first central sub-region 120A has cut-outs of different polygonal shapes, including triangle-shaped cutouts (including isosceles, scalene, and equilateral triangles), pentagon-shaped cutouts, octagon-shaped cutouts, rectangle-shaped cutouts, square-shaped cutouts, parallelogram-shaped cutouts, rhombus-shaped cutouts, trapezoid-shaped cutouts, linear shaped cutouts, 90-degree angle shaped cutouts, acute angular shaped cutouts, and obtuse angular shaped cutouts. Each of the central sub-regions 120A, 120B, 120C, and 120D is configured to receive polygonal shapes of a particular color (e.g., red shapes placed into sub-region 120A, blue shapes placed into sub-region 120B, orange shapes into sub-region 120C, and green shapes placed into sub-region 120D), whereby the board game includes polygonal shapes of various types and colors for placement into the cut-outs of the central sub-regions. In one possible implementation, the cutouts are metal, and the polygonal shapes to be fitted into the respective cutouts are magnets (or vice versa), so that the polygonal shapes will stay within the respective cutouts and not fall out when a minor disturbance to the board occurs (i.e., someone accidently bumping against a table on which the board is placed while the game is being played).

Each central sub-region also includes peg-accepting holes 130 for receiving score pegs, whereby a placement of a peg into a peg-accepting hole in a corresponding central sub-region indicates that a player assigned to that sub-region has moved his/her player piece one time around the positions on the outer peripheral portion 110 of the game board. In the example shown in FIG. 1, there are eight peg-accepting holes provided for each central sub-region, meaning that the first player to move their game piece eight times around the board in a particular direction (e.g., clockwise), and thereby places eight score pegs into the eight peg-accepting holes for his/her assigned central sub-region, wins the game. As shown in FIG. 1, two to four players can play the board game at the same time.

The equipment making up the board game includes: a) a game board 100 (which is described above and which is shown in FIG. 1), b) a deck of image/clue/question cards (also referred to herein as "quiz cards"), c) player pieces (for moving along the various positions on the peripheral region 110 of the game board), d) dice (each having a different number of sides), e) score pegs, and f) polygonal-shaped puzzle pieces. In one embodiment, there are 4 player pieces, 4 platonic solids dice (the hexahedron, i.e., 6-sided, the tetrahedron, i.e., 4-sided, the octahedron, i.e., 8-sided, and the dodecahedron, i.e., 12-sided), 32 score pegs (8 red, 8 blue, 8 green, and 8 orange), and 64 polygonal-shaped puzzle pieces (16 red, 16 blue, 16 green, and 16 orange).

Prior to beginning the game, the quiz cards are shuffled and placed face down next to the game board 100. Each player places their respective player piece on a "Start Corner" 101 of the peripheral region 110 of the game board that has the "Square" image, whereby a game can be played from anywhere from 2 to 4 players. Each player then rolls a particular one of the dice, for example, the 12-sided dice, whereby the player rolling the highest number goes first. If two players roll the same number, then they re-roll the dice until the deadlock is broken between them. The order of play progresses around the board to the first player's left as the players are seated about the game board.

Once the order of play has been established, play begins. The polygon on which the player piece is set determines the dice that is rolled. Thus, since play starts on the "Square" image position 101 on one corner of the peripheral region 110 of the game board, the player rolls the 6-sided dice (each of the faces on a hexahedron 6-sided dice is a square). When a player piece is moved to a position on the peripheral region 110 of the game board that corresponds to a small triangle image, the player will roll the 8-sided dice (each of the faces on an octahedron 8-sided dice is a triangle). When a player piece is moved to a position on the peripheral region 110 of the game board that corresponds to a large triangle image, the player will roll the 4-sided dice (each of the faces on a tetrahedron 4-sided dice is a triangle). When a player piece is moved to a position on the peripheral region 110 of the game board that corresponds to a pentagon image, the player will roll the 12-sided dice (each of the faces on a dodecahedron 12-sided dice is a pentagon).

Figure 2A:
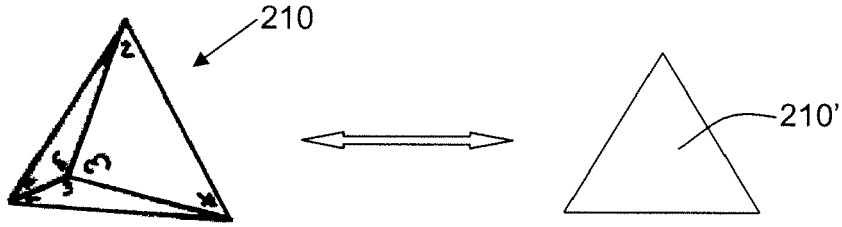
FIGS. 2A-2D show different shaped dice and their respective polygonal shaped faces that are utilized in playing a board game according to the first embodiment of the invention.
Figure 2B:
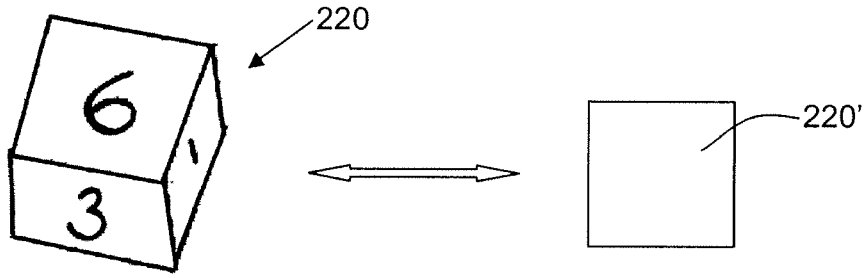
Figure 2C:
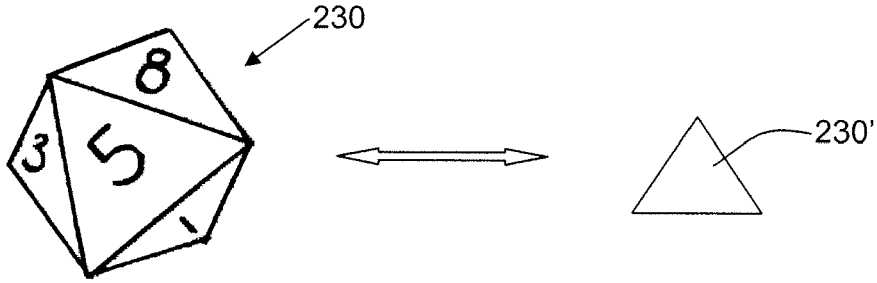
Figure 2D:
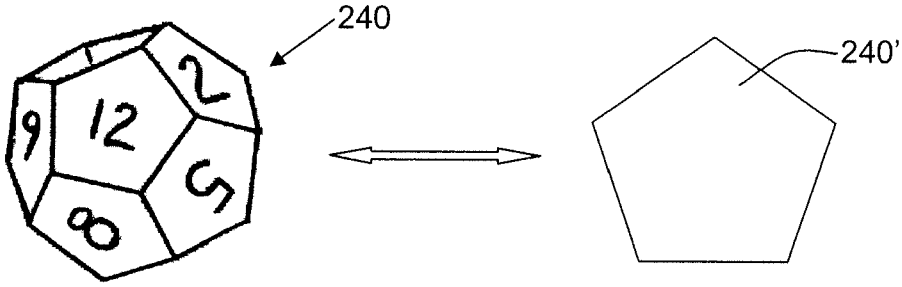
Figure 3A:
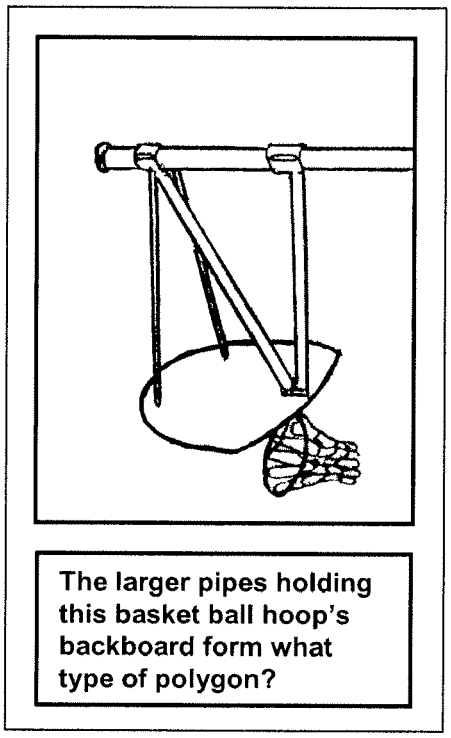
FIGS. 3A-3D show several examples of quiz cards that may be utilized in playing the board game according to the first embodiment of the invention. It is to be understood that photographic images can be used in place of the black and white line drawings depicted on these examples.
Figure 3B:
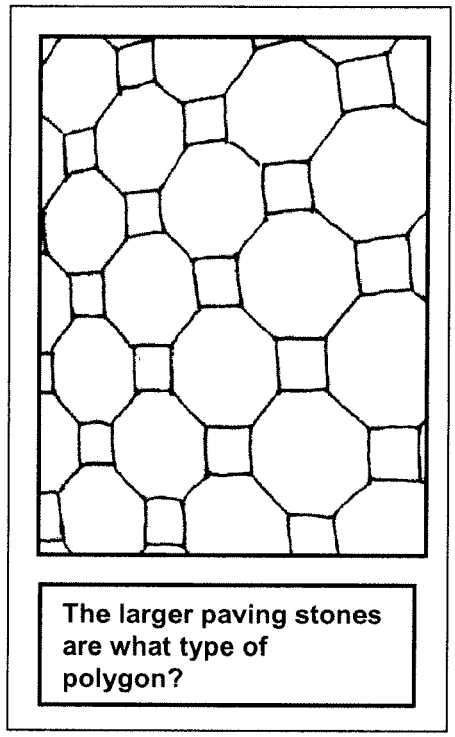
Figure 3C:
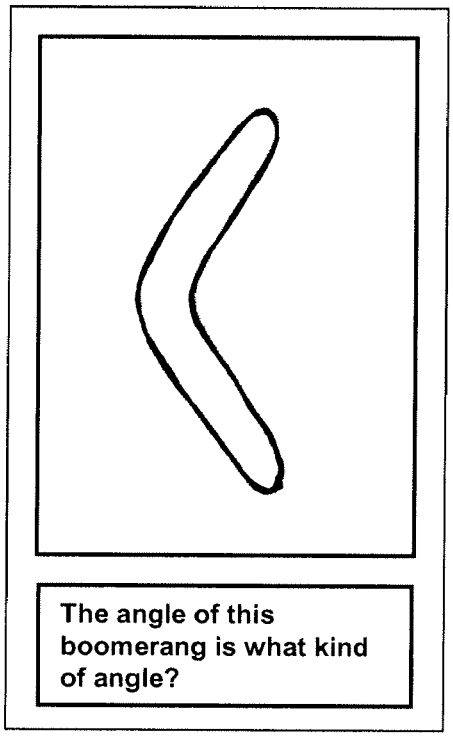
Figure 3D:
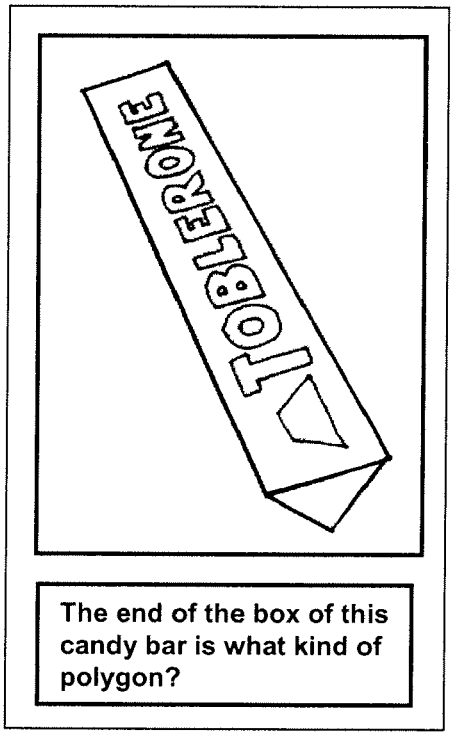

FIGS. 2A-2D show different shaped dice and their respective polygonal shaped faces that are utilized in playing the board game according to the first embodiment. In particular, FIG. 2A shows a four-sided dice 210 having four triangle-shaped outer faces 210', FIG. 2B shows a six-sided dice 220 having six square-shaped outer faces 220', FIG. 2C shows an eight-sided dice 230 having eight triangle-shaped outer faces 230', and FIG. 2D shows a twelve-sided dice 240 having twelve pentagon-shaped outer faces 240'. The dice 210 is rolled when a player moves to a position on the peripheral region 110 of the game board having a large-sized triangle image. The dice 220 is rolled when the player moves to a position on the peripheral region 110 of the game board having a square image. The dice 230 is rolled when the player moves to a position on the peripheral region 110 of the game board having a small-sized triangle image. The dice 240 is rolled when the player moves to a position on the peripheral region 110 of the game board having a pentagon image.

As stated above, since all player pieces start on the "Square" image position on one corner of the peripheral region 110 of the game board, the players all roll the 6-sided dice 220 first, in the order as determined by the rolling of the 12-sided dice 240 as described above. Movement of the player pieces begins clockwise around the peripheral region 110 of the game board.

After a player rolls the appropriate dice for the location of that player piece on the peripheral region 110 of the game board 100, the player piece is advanced on the game board 100 a number of positions according to the dice roll, and the player draws a quiz card from the top of the deck of the quiz cards. For example, if a player rolls a "six" when rolling the dice 220 on the "Square" image position 101, the player moves his/her player piece six positions clockwise to the pentagon image position 102 on the peripheral region 110 of the game board 100. Each of the quiz cards has a question related to geometry and/or polygons, such as "What is the polygonal shape associated with the Stop Sign shown in this picture?" FIGS. 3A, 3B, 3C, and 3D respectively show first, second, third, and fourth quiz cards 310, 320, 330, and 340 that may be utilized in the deck of quiz cards used in the first embodiment. If the player answers the question correctly (Correct Answer: Octagon), then the player piece of that player will move forward (clockwise) on the next turn. However, if the player answers the question incorrectly, then the player piece of that player will move backward (counter-clockwise) on the next turn.

If the player answers the question on the quiz card correctly, the puzzle piece that corresponds to the correct answer is placed by the player in the player's scoring sector, whereby the players' scoring sector corresponds to one of the central sub-regions 120A, 120B, 120C, 120D assigned to that player. Thus, for the example given above, if the player answered the "Stop Sign" question correct as "Octagon," then that player places an octagon-shaped puzzle piece into a corresponding octagon-shaped cutout in his/her assigned central sub-region (e.g., into an octagon-shaped cutout in central sub-region 120C). Play then advances to the next player playing the game. Preferably, each card has a picture or photograph on a first side of the card (e.g., a side facing up), whereby the picture signifies a particular polygonal shape to be identified by a player, whereby the correct answer is provided on a second side of the quiz card opposite the first side of the quiz card. The cards can be placed in a sleeve or container so that players cannot see the question before a card is drawn. The picture on the first side of the card may be accompanied by text asking the player to identify a polygonal shape provided on a particular part of the picture. Alternatively, one or more quiz cards may only include text with a polygonal question to be answered (e.g., What is the shape of a "Yield Sign"?).

Each time a player passes the "Start Corner" (that being the "Square" image 101 position on one corner of the peripheral region 110 of the game board 100) going in the clockwise direction, a score peg is placed by the player in a respective peg-accepting hole in that player's assigned central sub-region. Once a player has placed eight pegs into eight peg-accepting holes in his/her assigned central sub-region, thereby indicating that the player's piece has traveled eight times around the peripheral region 110 of the game board in the clockwise direction, the game is over and that player is the winner of the game.

If, as a result of answering a question on a card incorrectly, a player piece passes through the Start Corner 101 backwards (counter-clockwise), then that player has to remove a score peg that had been previously placed in a peg hole in that player's assigned central sub-region. If the player then answers the next question provided on a card correctly, the player then moves through the Start Corner in the forward direction (clockwise), and the score peg is earned back and thereby placed by the player in a peg hole in that player's assigned central sub-region.

A player wins the game when either he/she has traversed the game board 100 eight times in the forward direction (and thus has placed eight score pegs into eight peg holes in his/her assigned central sub-region), or when a player fills in all of the puzzle pieces in the respective puzzle piece cut-outs provided in his/her assigned central sub-region based on correctly answering the questions provided on the quiz cards. As shown in FIG. 1, the puzzle piece cut-outs include: a) rhombus cut-out, b) octagon cut-out, c) trapezoid cut-out, d) parallelogram cut-out, e) isosceles triangle cut-out, f) rectangle cut-out, g) square cut-out, h) pentagon cut-out, i) hexagon cut-out, j) equilateral triangle cut-out, k) decagon cut-out, l) obtuse angle cut-out, m) right angle cut-out, n) straight line cut-out, o) acute angle cut-out, and p) scalene triangle cutout.

Figure 4A:
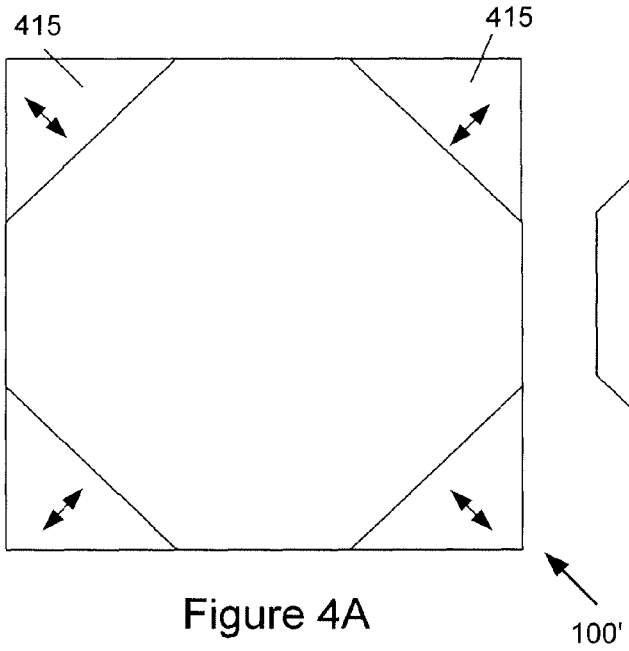
FIGS. 4A, 4B, and 4C show a game board according to a second embodiment of the invention.
Figure 4B:
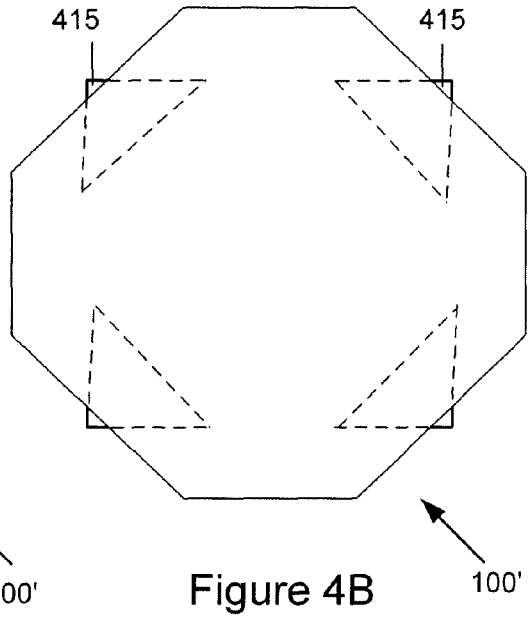
Figure 4C:
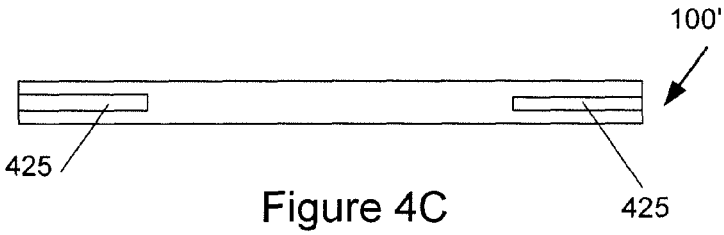

FIGS. 4A, 4B, and 4C show a game board according to a second embodiment of the invention. In the second embodiment, the game board and the way the game is played are identical to that described above with respect to the first embodiment, but whereby the game board top surface can be shaped so as to be a particular polygonal shape. For example, FIG. 4A shows the game board 100' with end pieces 415 fully extended, so that the game board has a square shape (same shape as the first embodiment). FIG. 4B shows the game board 100' with the end pieces 415 fully retracted into a middle part of the game board 100', so that the game board 100' has an octagonal shape. The double-arrows shown in FIG. 4A show the direction which the respective end pieces 415 can move with respect to the game board 100'. Tips of the end pieces 415 extend partially out (e.g., about ¼" to ½") from the sides of the game board when the end pieces 415 are fully retracted, as shown in FIG. 4B, so that they can be readily grasped by a player to thereby pull them out if the square shaped game board is desired. FIG. 4C shows slots 425 provided at the respective edges (four slots are provided, whereby only two of those slots are shown in the side view of FIG. 4C), in which the end pieces 415 are respectively disposed. For the FIG. 4B octagonal-shaped game board 100', a game overlay sheet can be provided for the periphery of the game board 100' so as to create an octagonal-shaped game piece path on the periphery of the game board 100'.

Figure 4D:
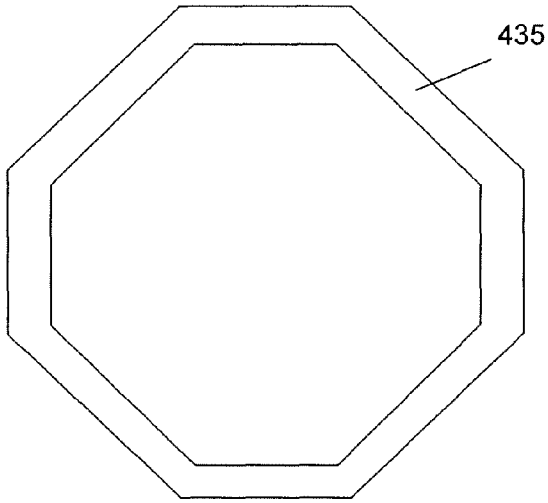
FIG. 4D shows an overlay sheet that can be used with the game board according to the second embodiment of the invention.

FIG. 4D shows such an octagonal-shaped overlay sheet 435 that covers an outer portion of the top surface of the game board 100'. The overlay sheet 435 can be releasably affixed to the top surface of the game board 100' by having the overlay sheet 435 being made of a magnetic material and having the top surface of the game board 100' being metal, or by using VELCRO™ strips on both the top surface of the game board 100' and the bottom surface of the overlay sheet 435, for example.

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. The spirit and scope of the invention are indicated by the following claims.

What is claimed is:

1. A board game, comprising:

a plurality of polygonal objects of a particular color, a plurality of dice each having a different number of faces as compared to others of the plurality of dice, wherein a first one of the plurality of dice has N faces, and a second one of the plurality of dice has M faces, N and M being integer values greater or equal to four, with N not being equal to M, a board having an upper surface with a peripheral region and a central region, the peripheral region having a plurality of positions for placement of player pieces thereupon, each peripheral region having located thereon an image of one of a plurality of polygonal shapes, the central region having a plurality of central sub-regions, each of which has a plurality of polygonal cut-outs corresponding to indentations that extend into the board from the upper surface of the board, for receiving a corresponding one of a plurality of polygonal objects of a particular color that are shaped in a same manner as the polygonal cut-out, a plurality of peg-accepting holes provided at an outer portion of each of the plurality of central sub-regions, wherein pegs are fitted into the peg-accepting holes to denote a complete passage of the entirety of the plurality of positions of the peripheral region by one of the player pieces of a player playing the board game, wherein the plurality of positions of the peripheral region collectively form a square-shaped path without any upper surface indentations provided thereon, the square-shaped path totally enveloping the central region.

2. The board game according to claim 1, wherein the board is square-shaped.

3. The board game according to claim 1, wherein N is equal to four, and M is equal to six, and wherein each of the four faces of the first one of the plurality of dice has a triangular shape, and wherein each of the six faces of the second one of the plurality of dice has a square shape.

4. The board game according to claim 1, further comprising:

first, second, third and fourth slots respectively provided at first, second, third and fourth corners of the board; and first, second, third and fourth triangular-shaped end pieces respectively disposed within the first, second, third and fourth slots, the first, second, third and fourth triangular-shaped end pieces respectively capable of sliding inward and/or outward within the first, second, third and fourth slots, wherein, in a first position of the first, second, third and fourth slots constituting a most-outwards positioning of the first, second, third and fourth slots, the board and the first, second, third and fourth slots collectively form a square-shaped board, and wherein, in a second position of the first, second, third and fourth slots constituting a most-inwards positioning of the first, second, third and fourth slots, the board and the first, second, third and fourth slots collectively form an octagonal-shaped board.

5. The board game according to claim 1, wherein each of the plurality of central sub-regions constitutes a triangular-shaped contiguous region within a middle portion of the upper surface of the board.

6. The board game according to claim 1, further comprising an overlay sheet configured to attached to the upper surface of the board, wherein the overlay sheet is constituted of magnetic material, wherein the board is constituted of metal, and wherein the overlay sheet is releasably attachable to the board to allow one of a plurality of different overlay sheets to be attached to the board to allow the board game to be played with different positions for placement of player pieces on the peripheral region of the board.

7. The board game according to claim 1, further comprising an overlay sheet configured to attached to the upper surface of the board, wherein the overlay sheet includes VELCRO™ strips provided on a bottom surfaces thereof, wherein the board includes VELCRO™ strips provided on the upper surface thereof, and wherein the overlay sheet is releasably attachable to the board by virtue of the VELCRO™ strips, to allow one of a plurality of different overlay sheets to be attached to the board to allow the board game to be played with different positions for placement of player pieces on the peripheral region of the board.

8. The board game according to claim 1, further comprising:

a plurality of cards having a front surface and a back surface, each of the plurality of cards having a picture that includes a polygonal object and text corresponding to a question concerning the polygonal object of the front surface, and each of the plurality of cards includes text corresponding to an answer to the question on the back surface.

9. A board game, comprising:

a plurality of polygonal objects of a particular color, a plurality of dice each having a different number of faces as compared to others of the plurality of dice, wherein a first one of the plurality of dice has N triangular faces, and a second one of the plurality of dice has M square faces, N and M being integer values greater than or equal to four, with N not equal to M; and a board having an upper surface with a peripheral region and a central region, the peripheral region having a plurality of positions for placement of player pieces thereupon, each peripheral region having located thereon an image of one of a plurality of polygonal shapes, the image on one of the plurality of positions corresponding to a triangle and the image on another of the plurality of positions corresponding to a square, the central region having a plurality of central sub-regions, each of which has a plurality of polygonal cut-outs corresponding to indentations that extend into the board from the upper surface of the board, for receiving a corresponding one of a plurality of polygonal objects of a particular color that are shaped in a same manner as the polygonal cut-out, a plurality of peg-accepting holes provided at an outer portion of each of the plurality of central sub-regions, wherein pegs are fitted into the peg-accepting holes to denote a complete passage of the entirety of the plurality of positions of the peripheral region by one of the player pieces of a player playing the board game, wherein a player rolls the first one of the plurality of dice when the player piece of the player rests on the one of the plurality of positions having an image corresponding to a triangle, and the player rolls the second one of the plurality of dice when the player piece of the player rests on the another of the plurality of positions having an image corresponding to a square.

10. The board game according to claim 9, further comprising:

first, second, third and fourth slots respectively provided at first, second, third and fourth corners of the board; and first, second, third and fourth triangular-shaped end pieces respectively disposed within the first, second, third and fourth slots, the first, second, third and fourth triangular-shaped end pieces respectively capable of sliding inward and/or outward within the first, second, third and fourth slots, wherein, in a first position of the first, second, third and fourth slots constituting a most-outwards positioning of the first, second, third and fourth slots, the board and the first, second, third and fourth slots collectively form a square-shaped board, and wherein, in a second position of the first, second, third and fourth slots constituting a most-inwards positioning of the first, second, third and fourth slots, the board and the first, second, third and fourth slots collectively form an octagonal-shaped board.

11. The board game according to claim 9, wherein each of the plurality of central sub-regions constitutes a triangular-shaped contiguous region within a middle portion of the upper surface of the board.

12. The board game according to claim 9, further comprising an overlay sheet configured to attached to the upper surface of the board, wherein the overlay sheet is constituted of magnetic material, wherein the board is constituted of metal, and wherein the overlay sheet is releasably attachable to the board to allow one of a plurality of different overlay sheets to be attached to the board to allow the board game to be played with different positions for placement of player pieces on the peripheral region of the board.

13. The board game according to claim 9, further comprising an overlay sheet configured to attached to the upper surface of the board, wherein the overlay sheet includes VELCRO™ strips provided on a bottom surfaces thereof, wherein the board includes VELCRO™ strips provided on the upper surface thereof, and wherein the overlay sheet is releasably attachable to the board by virtue of the VELCRO™ strips, to allow one of a plurality of different overlay sheets to be attached to the board to allow the board game to be played with different positions for placement of player pieces on the peripheral region of the board.

14. The board game according to claim 9, further comprising:

a plurality of cards having a front surface and a back surface, each of the plurality of cards having a picture that includes a polygonal object and text corresponding to a question concerning the polygonal object of the front surface, and each of the plurality of cards including text corresponding to an answer to the question on the back surface.

* * * * *